United States Patent [19]

Wagner et al.

[11] 4,090,715

[45] May 23, 1978

[54] SOLAR POWERED SPINNING APPARATUS

[76] Inventors: Clyde M. Wagner; John H. Wagner, both of 108 N. Sparta St., Steeleville, Ill. 62288

[21] Appl. No.: 726,448

[22] Filed: Sep. 24, 1976

[51] Int. Cl.[2] ..... A63F 5/04; A63H 29/22

[52] U.S. Cl. ..... 273/141 A; 46/248; 46/269; 272/31 R

[58] Field of Search ..... 273/141 A, 147, 138 A, 273/145 E; 46/269, 256, 45, 49, 48, 234, 235, 248; 272/31 A, 31 B, 31 P, 31 R; 310/4

[56] References Cited

U.S. PATENT DOCUMENTS

| | | | |
|---|---|---|---|
| 2,069,134 | 1/1937 | Collins et al. | 273/141 A |
| 2,613,931 | 10/1952 | Singer | 272/31 R |
| 3,253,365 | 5/1966 | Calderon | 46/269 |
| 3,551,709 | 12/1970 | Kemenczky | 46/269 X |
| 3,841,637 | 10/1974 | Piazza | 273/141 A |

FOREIGN PATENT DOCUMENTS

| | | | |
|---|---|---|---|
| 841,259 | 6/1952 | Germany | 46/256 |
| 1,009,079 | 5/1957 | Germany | 46/269 |
| 1,040,952 | 10/1958 | Germany | 273/147 |

OTHER PUBLICATIONS

Cenco 1969 Educational Catalog, p. 114, Solar Energy Demonstration Kit.

*Primary Examiner*—Richard C. Pinkham
*Assistant Examiner*—Arnold W. Kramer
*Attorney, Agent, or Firm*—Lionel L. Lucchesi

[57] ABSTRACT

A toy top device adapted for a variety of uses is provided which utilizes a solar energy conversion means for powering the top. The device includes a base structure having an electric motor mounted to it so that a motor shaft and rotor assembly of the motor remain stationary while a stator assembly of the motor rotates. An enclosure is mounted to the stator assembly and rotates with it. The enclosure includes a translucent top wall and a side wall which together define a cavity. The enclosure carries the solar energy conversion means in light communicating relationship with the top wall, and is electrically connected to the motor. The enclosure preferably has a design silhouette resembling a conventional toy top. It may be used as a conventional spinning toy top. However, the device is adaptable to various uses by simple interconnection of additional structure to the enclosure.

8 Claims, 6 Drawing Figures

SOLAR POWERED SPINNING APPARATUS

BACKGROUND OF THE INVENTION

This invention relates to toy top devices, and in particular, to a toy top structure which is adaptable to a variety of uses.

The prior art reveals a number of spinning toys of various designs and configurations. While these prior art devices work for their intended purposes, they have been handicapped by the fact that a continuous power source has not been available for operating the device. My invention overcomes this prior art difficulty by providing a top-like enclosure for an electrical motor. The motor itself is an inverted design so that the motor shaft resembles the rotating point of the toy top. In this invention, however, the shaft is fixed along a support structure and the stator assembly, normally the stationary member of the electric motor, rotates with respect to the rotor assembly and its associated motor shaft. The enclosure includes means for mounting the enclosure to the stator assembly of the motor, and a solar energy conversion means which is positioned to receive light through a translucent top wall of the enclosure. The solar energy conversion means, in turn, is the motor power source and is electrically connected to the motor. The structure disclosed also permits the device to be put to a variety of uses, with relatively easy conversion between those uses.

One of the objects of this invention is to provide an improved solar powered spinning top device.

Another object of this invention is to provide an economical spinning top construction.

Yet another object of this invention is to provide a device having a plurality of uses which are interchangeable with one another.

Other objects of this invention will be apparent to those skilled in the art in light of the foregoing description and accompanying drawings.

SUMMARY OF THE INVENTION

In accordance with this invention, generally stated, a top like structure is provided with an electric motor having a rotor assembly and a stator assembly, The rotor assembly includes a shaft which is fixed to a support structure on one end of the shaft, and to the rotor assembly at the other end of the shaft. The stator assembly is mounted for rotation with respect to the rotor assembly. An enclosure having a translucent top and a side wall, which together define a cavity, encloses the motor. The enclosure is mounted for rotation with the stator assembly. A solar conversion means also is mounted for rotation with the stator assembly and is positioned so that electromagnetic energy passing through the translucent top activates the solar conversion means and energizes the motor.

DESCRIPTION OF THE PREFERRED EMBODIMENT

Figure 1:
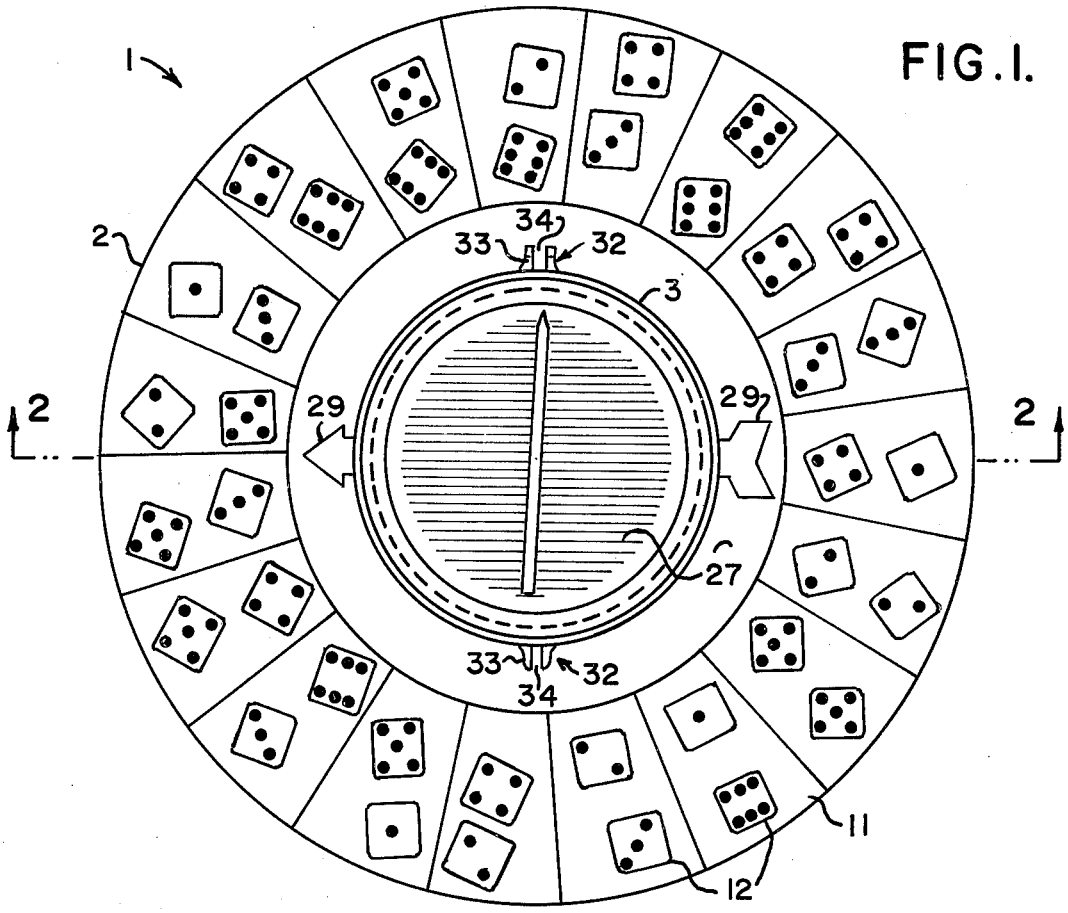
FIG. 1 is a top plan view of one illustrative embodiment of toy top device of this invention.

Referring now to FIG. 1, reference numeral 1 indicates one illustrative embodiment of toy top amusement device of this invention. The device 1 includes a support structure or base 2, and a rotatable member or top 3.

The base 2, in the embodiment illustrated, is a circular or disc-shaped member 4 having an upper surface 5, a lower surface 6, and a material thickness 51 between the surfaces 5 and 6. The silhouette, size and thickness of the support structure 2 all may vary in embodiments of this invention. In general, the base 2 should have sufficient mass to prevent movement of the base during operation of the top 3, later described in detail. The base 2 may be formed from a variety of materials. Various moldable plastics work well, for example. Support structure 2 also has a central hub 7 projecting upwardly from the surface 5. Hub 7 has an axial opening 8 extending through it. The opening 8 is sized to receive a shaft 9 of a motor 10 in a tight, friction fit. The motor 10 and shaft 9 are described in greater detail hereinafter.

A plate 11 is mounted to the surface 5 of the support structure 2 by any convenient method. In the embodiment illustrated, the plate 11 is an annular device having a plurality of indicia 12 displayed on it. The size, shape, location and nature of the indicia 12 all may vary, depending in large measure on the use to which the device 1 is put. The plate 11 preferably is removably mounted to the surface 5. Attachment may be accomplished by the use of a removable adhesive, for example, or the support structure 2 may have a lip, not shown, about its periphery, for receiving the plate 11. Other attachment methods and means are compatible with the broader aspects of this invention.

The top or rotatable member 3 includes the motor 10 and an enclosure 13. Motor 10 is of conventional construction, including a stator assembly 14, and a rotor assembly 15 enclosed in a suitable housing 16. The rotor assembly 15 is attached to the shaft 9, and is journaled along a pair of bearings 50 to permit relative rotation between the rotor assembly and the stator assembly. In most conventional electrical motor applications, the stator assembly is fixed and the rotor assembly is free to rotate upon the application of electrical energy to the motor. Although inside out motor constructions are known in the art, the motor 10 is not an inside out motor in the conventional sense. Rather, the motor 10 is arranged so that the rotor and stator assemblies merely reverse their roles. That is to say, the shaft 9 is held in position along the hub 7, while the stator assembly 10 is permitted to rotate upon energization of the motor 10.

Figure 3:
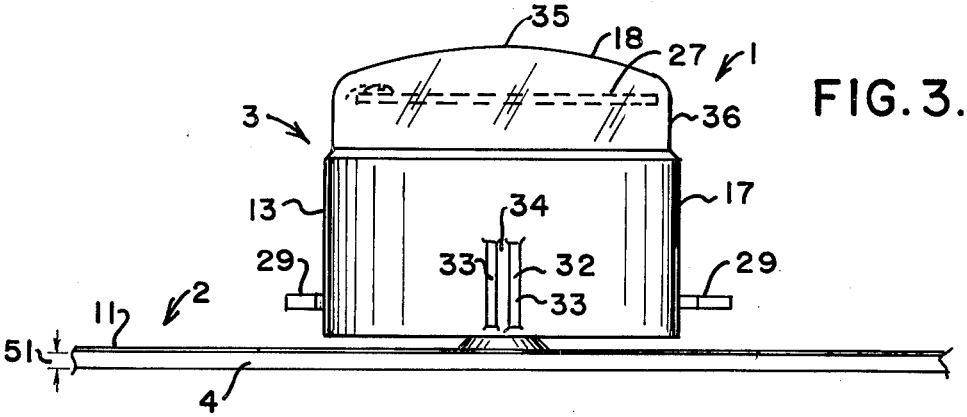
FIG. 3 is a view in side elevation, partly broken away, of the device shown in FIG. 1.

Enclosure 13 is mounted to the housing 16 of the motor 10, and is rotatable with the stator assembly 14. The operational reversal of conventional motor structure used with my invention enables the device 1 to resemble or operate in a manner similar to the ordinary toy top. That is to say, the design of the enclosure 13 generally conforms to a conventional toy top design, so that the enclosure 13 gives the appearance of coming to and rotating about a point at its lower end, lower being referenced to FIG. 3. In reality, of course, the point of rotation is along the bearings 50 of the motor 10.

Enclosure 13, includes a cylindrical section 17, a top section 18, and a mounting structure 19.

Figure 2:
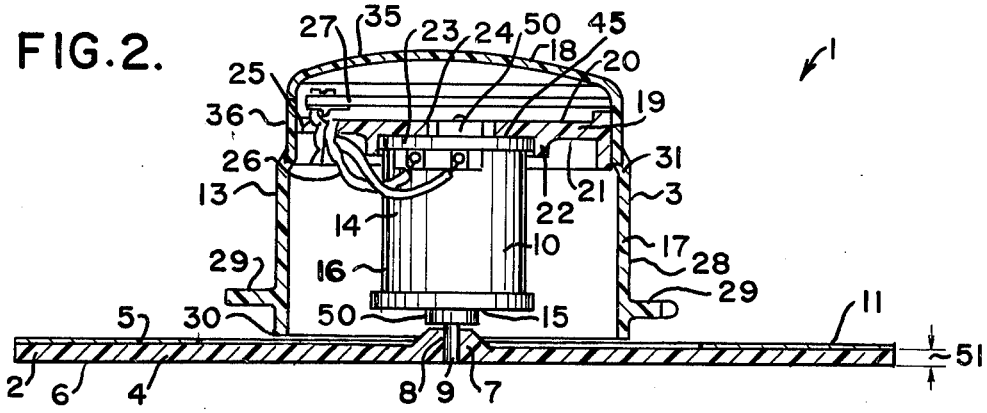
FIG. 2 is a sectional view taken along the line 2—2 of FIG. 1.

Mounting structure 19 has an upper side 20 and a lower side 21. The side 21 has a receptacle 22 formed in it, which is sized to receive an end 23 of the motor 10 in a tight friction fit. The particular motor 10 illustrates in FIG. 2 has the bearings 50 extending outwardly on each end of the enclosure 16. For that reason, a bottom 45 of the receptacle 22 has an opening 24 in it, which permits passage of the bearing 50 and the associated shaft end. Again, the opening 24 preferably is sized to receive the bearing 50 in a right, friction fit, which acts to improve the receptacle 22 — motor 10 interlock. Plate 19 also has an opening 25 through it, which permits passage of a plurality of electrical conductors 26. Conductors 26 are electrically connected between the motor 10 and at least one solar energy conversion means 27. Solar energy conversion means 27 is conventional and may comprise any of a variety of commercially available solar energy converters or cells adapted to convert incoming electromagnetic radiation to a more conventional form of electrical power. The solar energy conversion means 27 is attached to the mounting structure 19 on the surface 20 side of the mounting structure. Attachment may be accomplished by any convenient method.

As indicated above, the section 17 of the enclosure 13, is a cylindrical section having an outer wall 28. The section 17 is open ended, and has an axial length such that an end 30 of the section 17 is positioned near the surface 5 of the support structure 2. An end 31 of the section 17 is sized to receive the top section 18 of the enclosure 13. Interconnection between the section 17, section 18 and mounting plate 19 may be accomplished by a variety of common expedients. For example, the enclosure 13 may be constructed from various plastic materials and interconnected by fusion, epoxy or complementary snapping devices.

A pointer means 29 is integrally formed with the section 17. The pointer means 29 is useful in various adaptations of the device 1, as later described in detail. The section 17 also has a pair of connection means 32 integrally formed with it. The connection means 32 includes a pair of elongated arms 33 extending radially outwardly from the cylindrical section 17, which define a groove 34. The connection means 32 too is useful in the various adaptations of the device 1.

Top section 18 preferably is constructed from clear or translucent plastic, and includes a top wall 35 and an integrally formed side 36. The top section 18 is connected to the cylindrical section 17 along the side wall 36 of the top section, as previously described. The top section 18 is designed to pass electromagnetic radiation, enabling that radiation to strike the solar conversion means 27.

Operation of the device 1 is relatively simple to understand. Placing the device 1 in operative relationship with a source of electromagnetic radiation, which may be the sun or an incandescent lamp, for example, causes the solar conversion means 27 to generate electrical power. Electrical energy from the solar conversion means 27 is utilized to operate the motor 10. Upon energization, the stator assembly 14 begins to rotate about the bearings 50, rotating the top 3 in either clockwise or counterclockwise direction, depending upon the electrical connections of the motor 10. Removal of the source of electromagnetic radiation enables the motor 10 and top section 3 to come to rest, as friction overcomes the momentum of rotation.

In use, the device 1 can be put to a plurality of applications. As shown in FIG. 1, the indicia 12 of plate 11 is a plurality of the various combinations possible with a pair of dice. The device 1 in this instance may be used to select arbitrarily one of the combinations shown. That is, the solar energy conversion means 27 is irradiated to start rotation of the member 3. After rotation has commenced, the source of radiation is removed, and the member 3 is allowed to come to rest. At rest, the pointer means 29 indicates the randomly selected indicia 12. It will be apparent to those skilled in the art that a variety of other plates 11 with other indicia may be substituted for that shown. When used as a toy top, the size of the support structure 2 may be reduced. In the alternative, the design of the plate 11 may be changed to enhance the adaptability of the device to a toy top use.

Figure 4:
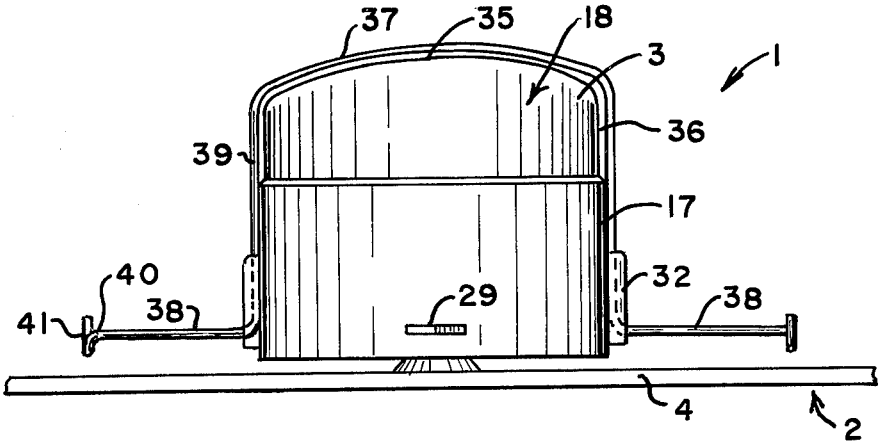
FIG. 4 is a view in side elevation, partly broken away, of the device shown in FIG. 1, adapted for a use different from that shown in FIG. 1.
Figure 5:
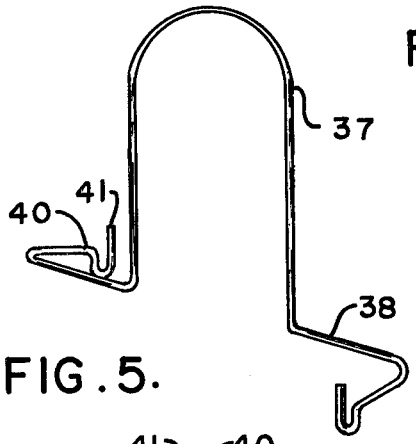
FIG. 5 is a view in perspective of one illustrative embodiment of an arm intermountable with the device of this invention for converting that device to other uses.
Figure 6:
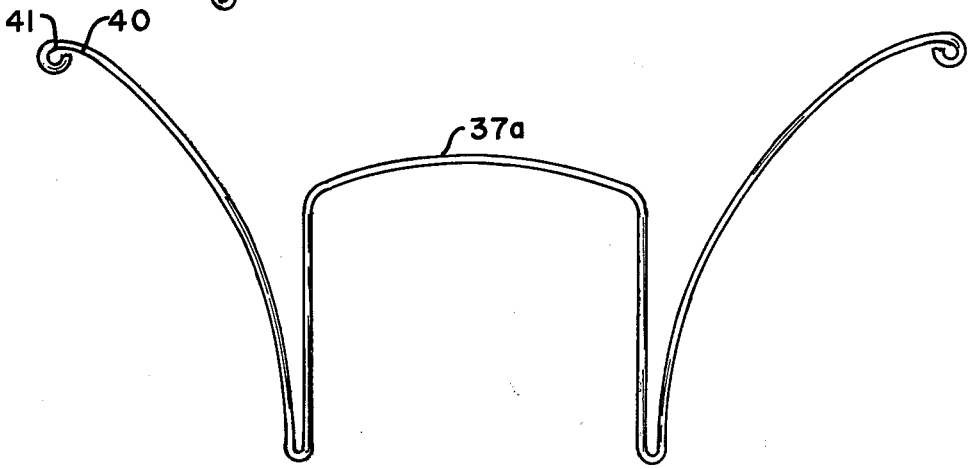
FIG. 6 is a view in perspective of a second embodiment of an arm for converting the device of this invention to other uses.

The device 1 also may be used for display purposes. As shown in FIGS. 4, 5 and 6, a connector 37 is attached to the top 3 along the connection means 32. The connector 37 includes a pair of outwardly extending legs 38 and a crossover section 39 which clamps within the groove 34 of the connection means 32, and crosses over the outer periphery of the top wall 35. An end 40 of the legs 38 is preformed to provide an attachment means 41. Attachment means 41 also may assume a variety of predetermined designs. Two such end terminations are shown in FIGS. 5 and 6 for a connector 37 and **37*a*. The connector 37 may be utilized, for example, to pull miniaturized toys or figurines along the surface 5 of the support structure 2, while the connector 37*a* is used to rotate a toy or other device above the surface 5 of the support structure 2. Thus, the connector 37 may be used to pull a tortoise and hare, for example, or other animal characters of antiquity, along the surface 5, while the connector 37*a* may be used to draw a pair of miniaturized airplanes above the surface 5. The wide variety of uses of the device 1** in this manner will be appreciated by those skilled in the art. In any event, simple interconnection for a variety of structures is provided by the particular end terminations shown in the drawings.

It is thus evident that a device is provided which is capable of adapting to a variety of uses, which is low cost and simple in design, and which meets all the ends and objects herein set forth.

Numerous variations, within the scope of the appended claims, will be apparent to those skilled in the art in light of the foregoing description and accompanying drawings. Thus, while various materials were indicated as preferred, other materials may be substituted for those described. The design silhouette of the various components of the device 1 may vary in other embodiments of this invention, as may physical dimensions of the components shown. Additional devices may be attached to the top 3, in place of or in addition to the connector 37. The design of the connector 37 itself may vary. Thus, the cross-over section 39 may be changed to cross around the outer diameter of the section 17. These variations are merely illustrative.

Having thus described the invention, what is claimed and desired to be secured by Letters Patent is:

1. A solar powered device, comprising:

a support structure, said support structure including an upper surface;

a plate mounted to the upper surface of said support structure, said plate having a plurality of indicia indicated on it;

an electric motor, said motor including a stator assembly and a rotor assembly, said rotor assembly having a shaft extending outwardly from said stator and rotor assemblies on at least one end of said motor, said extension being mounted to said support structure, said stator assembly being rotatably mounted with respect to said rotor assembly and said shaft; and top means mounted to said stator assembly and rotatable therewith, said top means comprising an enclosure having at least one side wall and a top wall, said side wall having pointer means integrally formed with it, individual ones of said indicia of said plate being arranged for alignment with said pointer, said top wall being transparent, said enclosure defining a cavity, means for mounting said enclosure to said stator assembly such that said stator assembly is within said cavity, said mounting means including a mounting plate attached to said enclosure, said mounting plate having a receptacle formed on a first side of it, said receptacle being sized to interlock with said motor, and solar energy conversion means mounted in said cavity in operative relationship with said top wall, said solar conversion means being operatively connected to said motor.

2. The device of claim 1 wherein said plate is removably mounted to said support structure.

3. The device of claim 2 wherein said side wall of said top means includes connection means integrally formed with it, said connection means comprising a pair of sides spaced from one another to define a longitudinal groove therebetween.

4. The device of claim 3 further characterized by a connector mounted to said connection means, said connector including a pair of arms extending radially outwardly from said side wall, and a cross-over section connecting said arms, said cross-over section extending along the periphery of said top means.

5. A toy, comprising:

a support structure, said support structure including an upper surface;

an electric motor, said electric motor including a stator assembly and a rotor assembly, said rotor assembly having a shaft extending from said stator and rotor assemblies on at least one end of said motor, the extension of said shaft being attached to and fixed with respect to said support structure, said stator assembly being rotatably mounted with respect to said rotor assembly and said shaft; and top means mounted to said stator assembly and rotatable therewith, said top means including an enclosure having at least one side wall and a top wall, said top wall being transparent, said side wall having attached to it means for interacting with the upper surface of said support structure to provide an amusement function with said device, said top means further including solar energy conversion means mounted in said enclosure to said top means in operative relationship with said top wall and electrically connected to said motor so that radiation of said solar energy conversion means energizes said motor.

6. The toy of claim 5 wherein said interacting means comprises a pointer attached to the side wall of the enclosure of said top means, and a plate mounted to the upper surface of said support structure, said plate having a plurality of indicia indicated on it, individual ones of said indicia of said plate being arranged for alignment with said pointer.

7. The toy of claim 5 wherein said interacting means comprises a connection means attached to the said side wall of said top means, said connection means permitting the attachment of additional structure to said top means, said connection means including means for frictionally engaging such additional structure.

8. A solar powered device, comprising:

a support structure;

an electric motor, said electric motor including a stator assembly and a rotor assembly, said rotor assembly having a shaft extending outwardly from said stator and rotor asemblies on at least one end of said motor, said extension being mounted to said support structure, said stator assembly being rotatably mounted with respect to said rotor assembly and said shaft;

top means mounted to said stator assembly and rotatable therewith, said top means comprising an enclosure defining a cavity and having at least one side wall and a top wall, said side wall including connection means integrally formed with it, said connection means comprising a pair of sides spaced from one another to define a longitudinal groove therebetween, said top wall being transparent, means for mounting said enclosure to said stator assembly such that said stator assembly is within said cavity, said mounting means including a mounting plate attached to said enclosure, said mounting plate having a receptacle formed on a first side of it, said receptacle being sized to interlock with said motor, and solar energy conversion means mounted to said cavity in operative relationship with said top wall, said solar conversion means being operatively connected to said motor; and a connector mounted to said connection means, said connector including a pair of arms extending radially outwardly from said side wall, and a cross over section connecting said arms, said cross over section extending along the periphery of said top means.

* * * * *